US008122826B2

(12) United States Patent
Richards

(10) Patent No.: US 8,122,826 B2
(45) Date of Patent: Feb. 28, 2012

(54) INFINITELY VARIABLE CUT OFF PRINTING PRESS

(75) Inventor: John Sheridan Richards, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 975 days.

(21) Appl. No.: 12/149,204

(22) Filed: Apr. 28, 2008

(65) Prior Publication Data

US 2009/0266252 A1 Oct. 29, 2009

(51) Int. Cl.
*B41F 7/02* (2006.01)
*B41F 13/02* (2006.01)

(52) U.S. Cl. ..... 101/221; 101/219; 101/180; 101/181

(58) Field of Classification Search ..... 101/220, 101/221, 179, 216, 217, 375, 376, 219, 229, 101/178, 180, 181, 183
See application file for complete search history.

(56) References Cited

U.S. PATENT DOCUMENTS

| | | | | | |
|---|---|---|---|---|---|
| 1,358,843 | A | * | 11/1920 | Grass | 101/142 |
| 2,663,255 | A | | 12/1953 | Parrish | |
| 4,057,014 | A | | 11/1977 | Thomas | |
| 4,402,263 | A | * | 9/1983 | Honkawa | 101/352.11 |
| 4,598,642 | A | * | 7/1986 | Sauer et al. | 101/415.1 |
| 5,353,703 | A | | 10/1994 | Rieker | |
| 5,711,225 | A | * | 1/1998 | Rasmussen | 101/483 |
| 5,950,536 | A | | 9/1999 | Erbstein | |
| 6,125,751 | A | * | 10/2000 | Korem | 101/180 |
| 6,327,975 | B1 | | 12/2001 | Izawa | |
| 6,789,478 | B1 | * | 9/2004 | Kasper et al. | 101/352.13 |
| 7,066,088 | B2 | | 6/2006 | McLean et al. | |
| 7,721,646 | B2 | * | 5/2010 | Herbert et al. | 101/217 |
| 2002/0096067 | A1 | * | 7/2002 | Kitai | 101/216 |
| 2003/0097946 | A1 | | 5/2003 | Kawabata et al. | |

FOREIGN PATENT DOCUMENTS

| | | | |
|---|---|---|---|
| DE | 41 04 209 A1 | | 8/1992 |
| DE | 10 2006 025897 | | 1/2007 |
| FR | 980.734 | * | 5/1951 |
| WO | WO2005108078 | * | 11/2005 |

* cited by examiner

*Primary Examiner* — Leslie J Evanisko
*Assistant Examiner* — Ruben Parco, Jr.
(74) *Attorney, Agent, or Firm* — Davidson, Davidson & Kappel, LLC

(57) ABSTRACT

A variable cutoff printing press is provided that includes a plate cylinder, a first blanket cylinder including a first circumferential section movable with respect to a second circumferential section, and a second blanket cylinder including a third circumferential section movable with respect to a fourth circumferential section. The first, second, third and fourth circumferential sections contact the plate cylinder during a printing mode and print continuous images having a cutoff length on a web. A method of printing is also provided.

17 Claims, 6 Drawing Sheets

INFINITELY VARIABLE CUT OFF PRINTING PRESS

BACKGROUND OF INVENTION

The present invention relates generally to a printing press and more specifically to a variable cut off apparatus and method.

U.S. Pat. No. 5,950,536 discloses a variable cutoff offset press unit wherein a fixed cutoff press is adapted to a variable cutoff press while maintaining the size of the blanket cylinders. A plate cylinder sleeve has a variable outer diameter, whereby a length of an image to be printed is varied proportionally to a variable outer diameter while maintaining an outer diameter of the gapless blanket cylinder sleeve constant. The size of a plate cylinder is changed by using a sleeve mounted over the plate cylinder or adding packing under a plate to increase the diameter of the plate cylinder.

U.S. Pat. No. 6,327,975 discloses a method and apparatus for printing elongate images on a web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable velocity motor rotates each blanket cylinder, while each time the associated impression cylinder is held away to create a space on the web for causing printing of the first or the second printing portion at required spacings.

U.S. Pat. No. 7,066,088 discloses a variable cut-off offset press system and method of operation which utilizes a continuous image transfer belt. The offset printing system comprises at least two plate cylinders adapted to have thereon respective printing sleeves. Each of the printing sleeves is adapted to receive colored ink from a respective ink source. The system further comprises at least an impression cylinder, wherein the image transfer belt is positioned to contact each of the printing sleeves at respective nips formed between respective ones of the plate cylinders and the at least one impression cylinder.

BRIEF SUMMARY OF THE INVENTION

A variable cutoff printing press is provided that includes a plate cylinder, a first blanket cylinder including a first circumferential section movable with respect to a second circumferential section, and a second blanket cylinder including a third circumferential section movable with respect to a fourth circumferential section. The first, second, third and fourth circumferential sections contact the plate during a printing mode and print continuous images having a cutoff length on a web.

A method of printing an image on a web with a cutoff using a variable cutoff offset printing press is also provided. The steps include transferring an image to a first circumferential section of a first cylinder movable with respect to a second circumferential section of a second cylinder; printing the image on a web with the first circumferential section; transferring a second image to the second circumferential section; and printing the second image on the web with the second circumferential section.

BRIEF DESCRIPTION OF THE DRAWINGS

The present invention is described below by reference to the following drawings, in which.

DETAILED DESCRIPTION

Variable cut off printing presses have been developed to allow for printing products of different sizes on the same printing press without having to change plate and blanket cylinders. Changing plate and blanket cylinders to correspond to the size of the image that needs to be printed can be a time consuming and difficult process and may also require purchasing and storing cylinders of multiple sizes.

Figure 1:
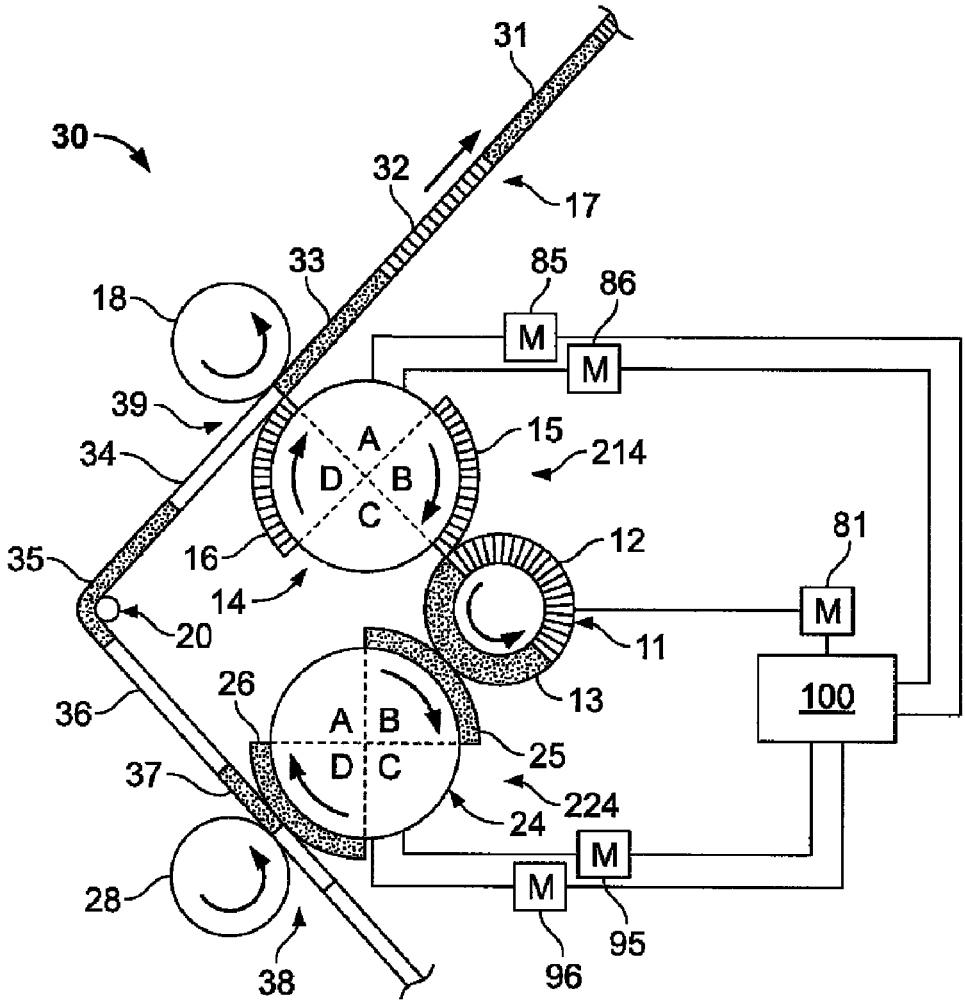
FIG. 1 shows a schematic side view of a nonperfecting printing press according to an embodiment of the present invention.

FIG. 1 shows a nonperfecting printing press 30 according to an embodiment of the present invention. Printing press 30 includes a plate cylinder 11 transferring inked image portions via plates 12, 13, mounted on plate cylinder 11, to raised blanket cylinders 214, 224, respectively, which in turn print the image portions on a passing web 17 during a printing mode. Blanket cylinders 214, 224 include respective blanket cylinder bodies 14, 24 and respective circumferential sections 15, 16, 25, 26 disposed about respective cylinder bodies 14, 24. During the printing mode circumferential blanket sections 15, 16, 25, 26 are rotated clockwise about respective blanket cylinder bodies 14, 24 by individuals motors 85, 86, 95, 96, respectively, and plate cylinder 11, including plates 12, 13, is rotated counterclockwise by a motor 81. A controller 100 controls motors 85, 86, 95, 96. Impression cylinder 18 contacts circumferential sections 15, 16 via web 17 at a nip 39 and impression cylinder 28 contacts circumferential sections 25, 26 via web 17 at a nip 38, during the printing mode.

Each blanket cylinder 214, 224, for illustrative purposes, can be broken up into four sections A, B, C and D, shown divided by the dashed lines in FIG. 1. For this embodiment, sections B and D are of equal size and the dashed lines of each blanket cylinder 214, 224 intersect at respective centers of blanket cylinders 214, 224. Each blanket cylinder 214, 224 has two raised circumferential sections 15, 16, 25, 26, respectively, located on surfaces of sections B and D. Each blanket cylinder 214, 224 also has two non-raised sections A and C, located in between circumferential sections 15, 16, 25, 26, respectively.

While each circumferential section 15, 16 performs a single revolution about blanket cylinder body 14, each circumferential section 15, 16 accepts an image portion from plate 12 and prints the image portion on passing web 17. While each circumferential section 25, 26 performs a single revolution about blanket cylinder body 24, each circumferential section 25, 26 accepts an image portion from plate 13 and prints the image portion on passing web 17. Circumferential sections 15, 16, 25, 26, along with plate cylinder 11, can be phased and positioned so that circumferential sections 15, 16, 25, 26 print image portions on web 17 that are aligned with adjacent image portions. Each circumferential section 15, 16, 25, 26 will print every fourth image portion on web 17. Circumferential sections 15, 16 will print every other image portion on web 17, with circumferential sections 25, 26 printing the intervening image portions. In a preferred embodiment no unprinted space will exist on web 17 between image portions printed on web 17 by circumferential sections 15, 16, 25, 26.

In the embodiment shown in FIG. 1, a lead roll 20 guides web 17. Lead roll 20 is positioned in relation to cylinders 214, 224 so that circumferential sections 15, 16, 25, 26 print image portions on web 17 that align with adjacent image portions. The length of web 17 between nips 38, 39 is determined by the position of lead roll 20, which can be adjusted as desired by moving lead roll 20. In an alternative embodiment, lead roll 20 can be eliminated, resulting in a direct path between nips 38, 39. Circumferential sections 15, 16, 25, 26 may also be accelerated and decelerated when circumferential sections 15, 16, 25, 26 are not in contact with respective plates 12, 13 or web 17, to ensure image portions printed by circumferential sections 15, 16, 25, 26 are properly aligned on web 17.

In an alternative embodiment a continuous plate carrying one continuous image may be disposed about plate cylinder 1 in place of plates 12, 13. In this alternative embodiment circumferential sections 15, 16 transfer a portion of the continuous image from the continuous plate to web 17 and circumferential sections 25, 26 transfers another portion of the continuous image from the continuous plate to web 17 so that the circumferential sections 15, 16, 25, 26 print the continuous image on web 17. Also, in another preferred embodiment, plates are not required, as images are imaged directly on plate cylinder 11.

In operation, for the embodiment shown in FIG. 1, plate cylinder 11 can rotate counterclockwise and transfer an image portion on plate 12 to circumferential section 15, which is being rotated clockwise about blanket cylinder body 14. Circumferential section 15 can continue to rotate clockwise and print the image portion on web 17, which can be traveling at a constant velocity in the direction of the arrow shown in FIG. 1. While circumferential section 15 is printing on web 17, circumferential section 16 can be rotating clockwise about blanket cylinder body 14 and receiving the same image portion that circumferential section 15 received from plate 12. Circumferential section 16 can continue to rotate about blanket cylinder body 14 and can print the image portion received from plate 12 on web 17 while circumferential section 15 is receiving the same image portion again from plate 12. Meanwhile, an image portion on plate 13 can be transferred to circumferential section 25, which is rotating clockwise about blanket cylinder 24. Circumferential section 25 can continue to rotate clockwise and print the image portion received from plate 13 on passing web 17. While circumferential section 25 is printing the image portion on web 17, circumferential section 26 can be rotating clockwise about blanket cylinder body 14 and receiving the same image portion from plate 13, which circumferential section 26 can print on web 17 while circumferential section 25 is receiving the same image portion again from plate 13.

Circumferential section 16 is beginning to print an image portion in a space 34 on web 17 directly following an image portion 33 printed by circumferential section 26, and directly preceding an image portion 35 printed by circumferential section 25. Directly preceding image portion 33 on web 17 is an image portion 32 printed by circumferential section 15, which is directly preceded by an image portion 31 printed by circumferential section 25. Directly following space 34 is image portion 35 printed by circumferential section 25 and a space 36 for an image portion to be printed by circumferential section 15. Circumferential section 26 is printing an image portion 37 on web 17, following a space 36. Preferably, after image portions are printed in spaces 34, 36 there is no space between image portions 31, 32, 33, the image portion printed in space 34, image portion 35, the image portion printed in space 36, and image portion 37. Two adjacent image portion may form one continuous image. In a preferred embodiment, each of these three exemplary continuous images has the same cutoff length.

In a preferred embodiment, blanket cylinder bodies 14, 24 can be equal size and circumferential sections 15, 16, 25, 26 can be equal size. In this embodiment, if sections A, B, C, D are each equal size, plates 12, 13 of plate cylinder 11 can be of equal length and can print images that are equal in length to plates 12, 13, respectively. Therefore, circumferential sections 15, 16, 25, 26 may be moving at the same constant velocity while printing images on web 17. As a result plate cylinder 11 can be moving at substantially a same velocity as web 17.

Plates 12, 13 can be replaced with replacement plates of nominally the same size carrying replacement images that differ in length from the images carried by plates 12, 13. Replacing plates 12, 13 with replacement plates having different image lengths allows an operator of printing press 30 to vary the cutoff of images printed on web 17.

Figure 2:
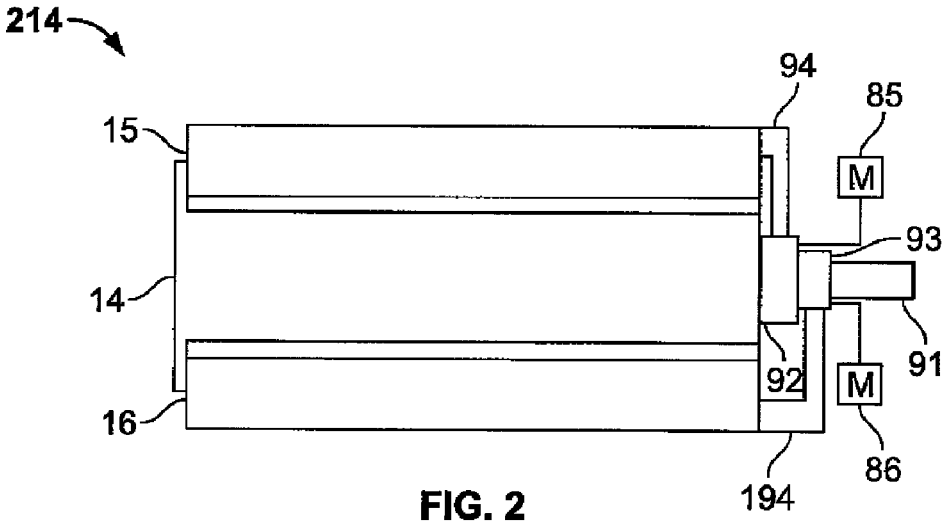
FIG. 2 shows a schematic front view of a blanket cylinder shown in FIG. 1.

FIG. 2 shows a schematic front view of an embodiment of blanket cylinder 214 shown in FIG. 1. Blanket cylinder 214 has a support shaft 91, which can attach to a frame or other supporting device to stabilize blanket cylinder body 14 and circumferential sections 15, 16. In this embodiment, circumferential sections 15, 16 independently rotate about blanket cylinder body 14. Circumferential sections 15, 16 are attached to support arms 94, 194, respectively. Support arms 94, 194 are attached to respective bearings 92, 93 that are rotatably attached to support shaft 91. Bearings 92, 93 are rotated by respective motors 85, 86 about support shaft 91, thereby driving circumferential sections 15, 16, respectively, about blanket cylinder body 14.

Figure 3:
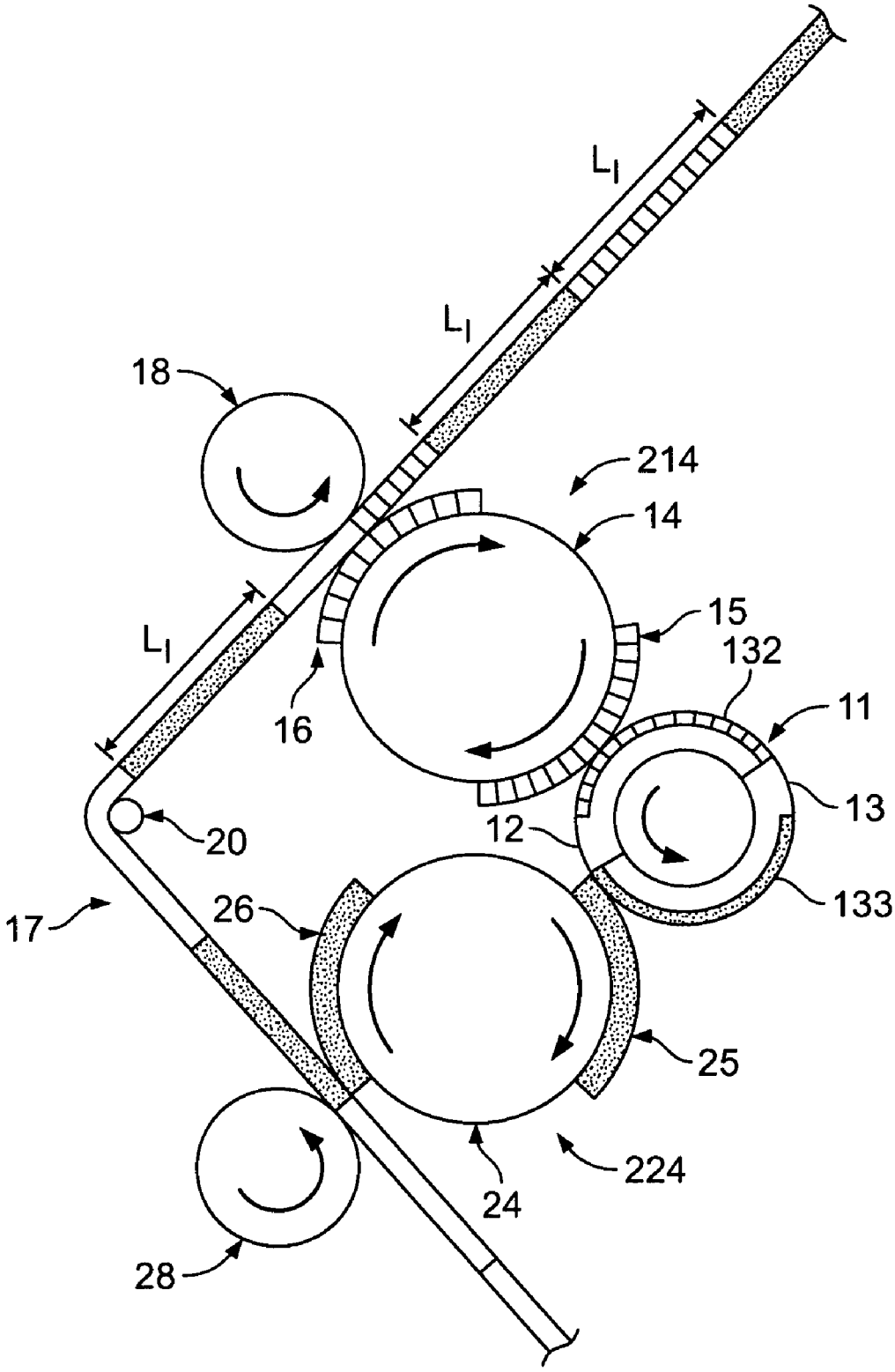
FIG. 3 shows a schematic side view of the nonperfecting printing press shown in FIG. 1 including inked images on the plates.

FIG. 3 shows a schematic side view of nonperfecting printing press 30 shown in FIG. 1 including inked image portions 132, 133 on plates 12, 13, respectively. Plate 12 of plate cylinder 11 transfers image portion 132 to circumferential section 15 and plate 13 of plate cylinder 11 transfers image portion 133 to circumferential section 25. The length of image portion 132 is less than the length of plate 12, therefore, a surface of plate 12 includes a non-print area. Similarly, the length of image portion 133 is less than the length of plate 13, therefore, a surface of plate 13 includes a non-print area.

During each full revolution plate cylinder 11 makes about an axis of plate cylinder 11 plate 12 transfers image portion 132 to one circumferential section 15, 16 of blanket cylinder 214 and plate 13 transfers image portion 133 to one circumferential section 25, 26 of blanket cylinder 224. During two full revolutions of plate cylinder 11, plate 12 transfers image portion 132 to both circumferential sections 15, 16 and plate 13 transfers image portion 133 to both circumferential sections 25, 26. In a time it takes plate cylinder 11 to make two full revolutions, circumferential sections 15, 16, 25, 26 travel an entire revolution about respective blanket cylinder bodies 14, 24. Therefore, circumferential sections 15, 16, 25, 26 each print one respective image portion 132, 133 on web 17 in the time plate cylinder 11 makes two complete revolutions.

To ensure proper alignment of image portions 132, 133 on web 17, web 17 can travel a distance equal to the total length of these four image portions in the time it takes plate cylinder 11 to make two entire revolutions. If image portions 132, 133 are the same image length $L_1$, and plates 12, 13 are the same plate length $L_P$, a time T in which web 17 travels a distance equal to four image lengths $L_1$ is equal to a time in which the surface of plate cylinder 11 travels a distance of four plate lengths $L_P$. Therefore, because the plate length $L_P$ of plates 12, 13 is greater than the image length $L_1$ of image portions 132, 133, the surface of plates 12, 13 must travel a greater distance than web 17 in the same amount of time T, the velocity $V_P$ of the surface of plates 12, 13 must be greater than the velocity of web 17 $V_W$ ($T=L/V_W=L_P/V_P$), in order for images 132, 133 to be properly aligned on web 17. For example, if plate cylinder 11, including plates 12, 13, has a permanent circumference of 50 inches, and is covered by plates 12, 13 that are each 25 inches long but each printing an image that is only 21 inches long, then web 17 travels 16% (50−(2)*(21))/50=8/50=0.16) more slowly than the surfaces of plates 12, 13.

When web 17 and surfaces of plates 12, 13 are traveling at different velocities the velocities of circumferential sections 15, 16, 25, 26 may need to be adjusted throughout each revolution to effectively interact with plates 12, 13 and web 17. When each circumferential section 15, 16, 25, 26 comes into contact with respective plate 12, 13 a surface of each circumferential section 15, 16, 25, 26 can be traveling at substantially the same velocity as a surface of respective plate 12, 13. When each circumferential section 15, 16, 25, 26 comes into contact with web 17 a surface of each circumferential section 15, 16, 25, 26 can be traveling at substantially the same velocity as web 17. Therefore, if surfaces of plates 12, 13 are traveling faster than web 17, each circumferential section 15, 16, 25, 26 can decelerate after receiving respective inked image portion 132, 133 from respective plate 12, 13 to reach the velocity of web 17 by the time respective circumferential section 15, 16, 25, 26 contacts web 17 to print respective image portions 132, 133 on web 17. Each circumferential section 15, 16, 25, 26 will then have to accelerate back to the surface velocity of respective plates 12, 13, in order to effectively receives images from respective plate 12, 13. In this embodiment spacing on a surface of blanket cylinder body 14 between circumferential sections 15, 16 and spacing on the surface of blanket cylinder body 24 between circumferential sections 25, 26 may be constantly changing as respective surface velocities of circumferential sections 15, 16, 25, 26 change.

Figure 4A:
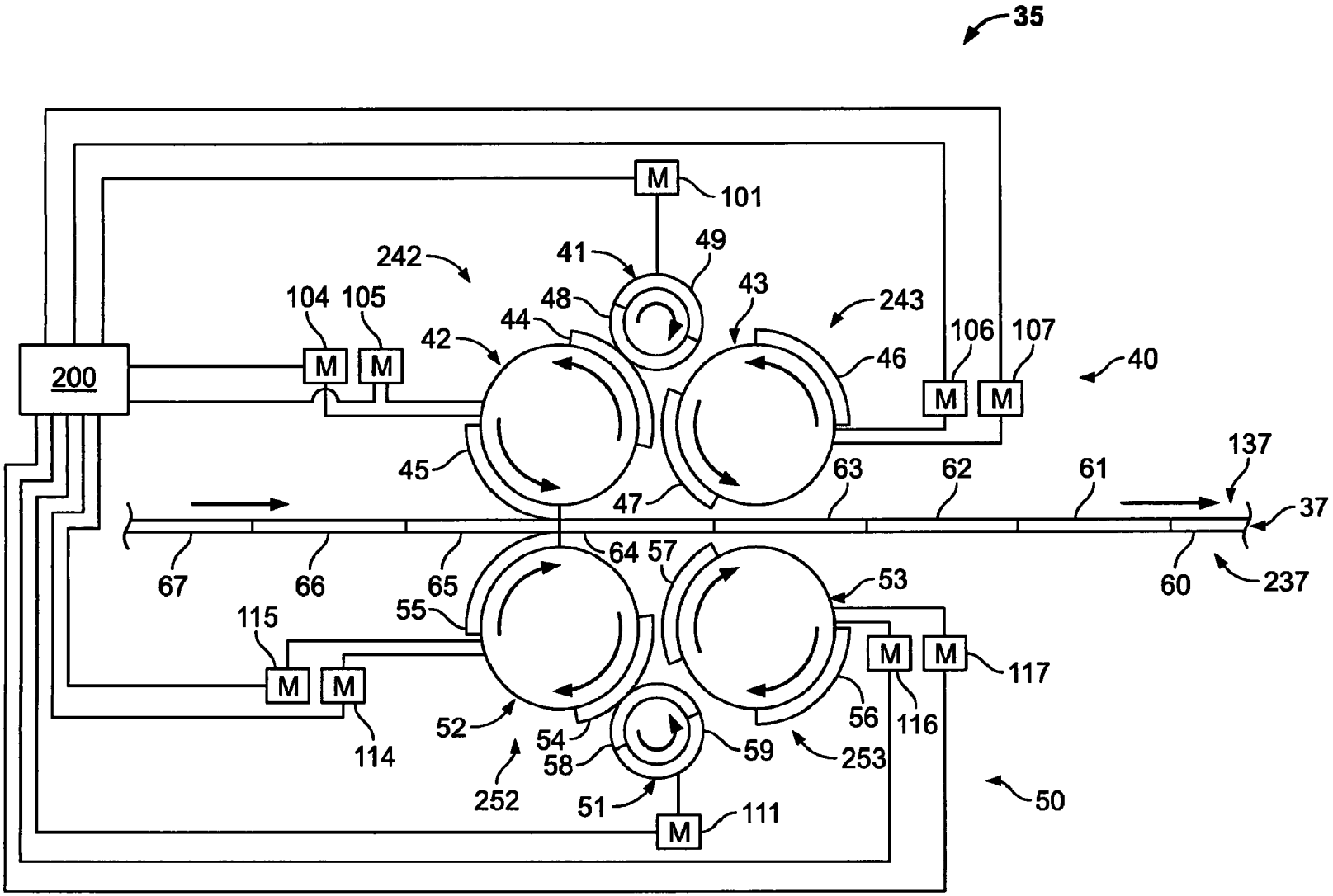
FIG. 4*a* shows a schematic side view of a perfecting printing press according to an embodiment of the present invention.
Figure 4B:
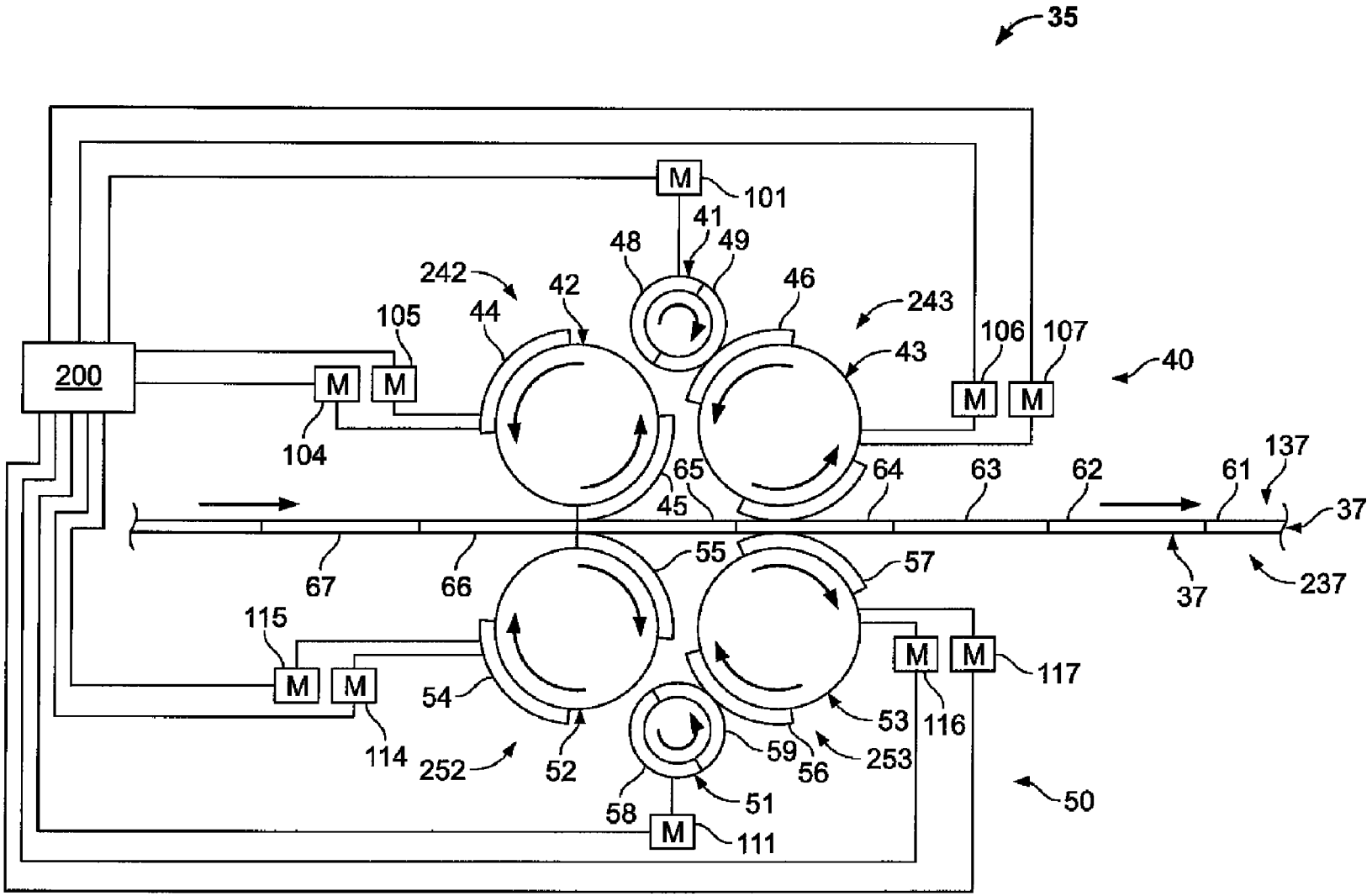
FIG. 4*b* shows a schematic side view of the perfecting printing press shown in FIG. 4*a;*
Figure 4C:
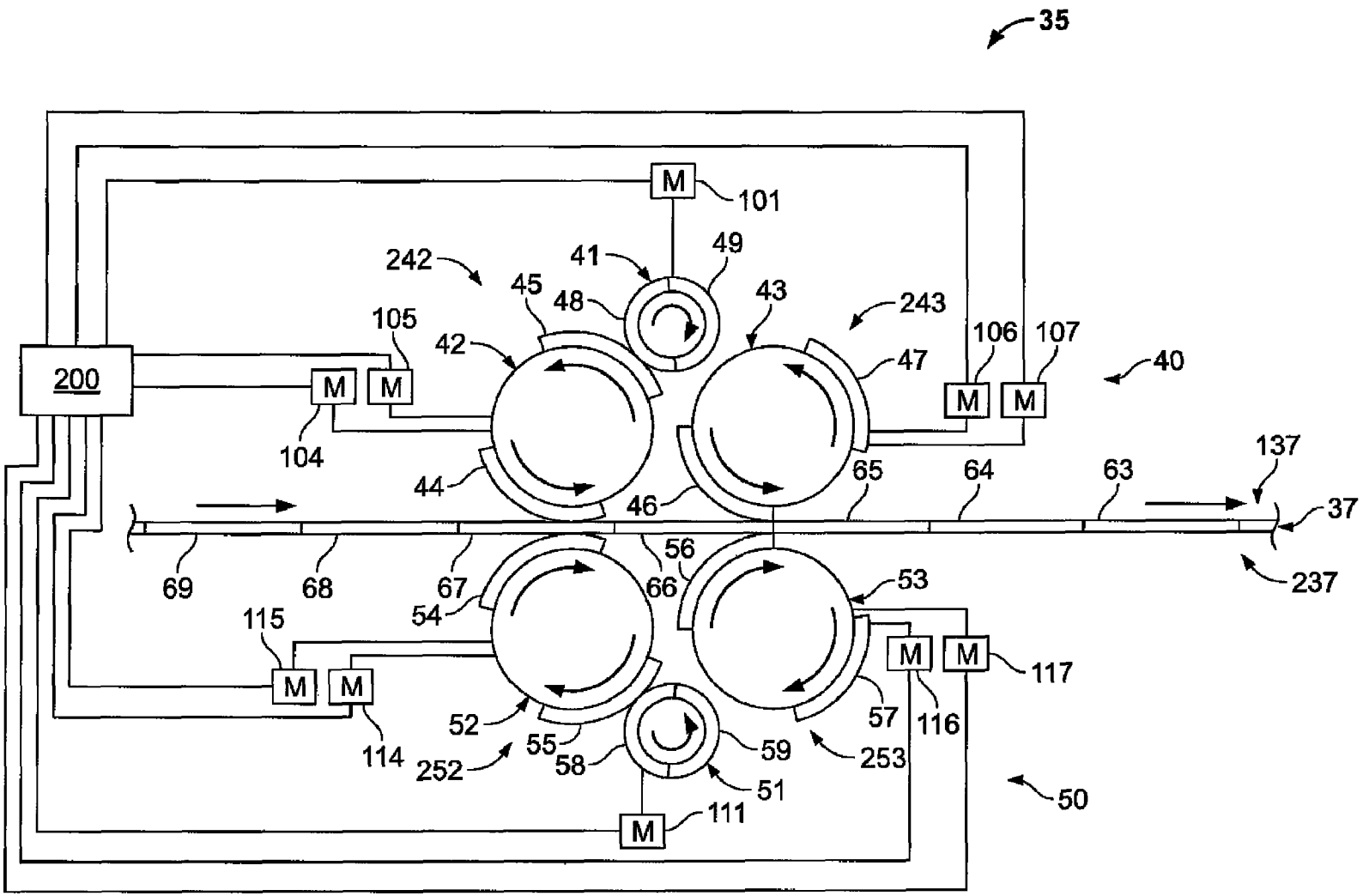
FIG. 4*c* shows a schematic side view of the perfecting printing press shown in FIGS. 4*a* and 4*b*.

FIGS. 4*a* to 4*c* show schematic side views of a perfecting printing press 35 according to an embodiment of the present invention while printing press 35 is in successive stages of printing images on a web 37. FIGS. 4*a* to 4*c* show an example of how, according to an embodiment of the present invention, circumferential sections may rotate to receive inked images from respective plates and print images on a web, in a manner similar to the embodiment in FIG. 1. Printing unit 40 prints on a first side 137 of a web 37 and printing unit 50 prints on a second side 237 of web 37. Printing units 40, 50 each include a plate cylinder 41, 51 and two blanket cylinders 242, 243, 252, 253, respectively. Plate cylinder 41 transfers inked images via plates 48, 49 to circumferential sections 44, 45, 46, 47 of blanket cylinders 242, 243. Circumferential sections 44, 45, 46, 47 then print the inked images on first side 137 of passing web 37. Plate cylinder 51 transfers inked images via plates 58, 59 to respective circumferential sections 54, 55, 56, 57 of blanket cylinders 252, 253. Circumferential sections 54, 55, 56, 57 print inked images on second side 237 of passing web 37. Plate cylinders 41, 51 can be rotated by respective motors 101, 111 during printing mode.

Blanket cylinders 242, 252, via respective circumferential sections 44, 45, 54, 55, can print every other image on respective sides 137, 237 of web 37, for example, in spaces 69, 67, 65, 63, 61. Blanket cylinders 242, 252 can print images on respective sides 137, 237 of web 37 at the same time, in the same horizontal position on web 37. Blanket cylinders 243, 253, via respective circumferential sections 46, 47, 56, 57, can print images in between the images printed by blanket cylinders 242, 252 on respective sides 137, 237 of web 37, for example, in spaces 68, 66, 64, 62, 60. Blanket cylinders 242, 252 can print images on respective sides 137, 237 of web 37 at the same time, in the same horizontal position on web 37. Respective images printed in spaces 69, 68, 67, 66, 65, 64, 63, 62, 61, 60 can be aligned with adjacent images, with no unprinted area between the respective images and without the respective images overlapping.

Circumferential sections 44, 45, 46, 47, 54, 55, 56, 57 can be accelerated and decelerated about blanket cylinder bodies 42, 43, 52, 53 of respective blanket cylinders 242, 243, 252, 253, by respective motors 104, 105, 106, 107, 114, 115, 116, 117 so that circumferential sections 44, 45, 46, 47, 54, 55, 56, 57 print respective images in the proper positions on web 37. A surface of circumferential sections 44, 45, 46, 47, 54, 55, 56, 57 can be traveling at the same velocity as web 37 when circumferential sections 44, 45, 46, 47, 54, 55, 56, 57 are printing images on web 37 and can be traveling at the same velocity as a surface of respective plate cylinders 41, 51 when circumferential sections 44, 45, 46, 47, 54, 55, 56, 57 are receiving images from respective plates 48, 49, 58, 59. A controller 200 can control motors 101, 104, 105, 106, 107, 111, 114, 115, 116, 117 so that printing units 40, 50 effectively print images on web 37 as desired by a user of printing press 35.

In the embodiments discussed above, circumferential sections 15, 16, 25, 26, 44, 45, 46, 47, 54, 55, 56, 57 are disposed about respective blanket cylinder bodies 14, 24, 42, 43, 52, 53; however, alternatively circumferential sections 15, 16, 25, 26, 44, 45, 46, 47, 54, 55, 56, 57 may, respectively, be circumferential sections on common axes with no respective blanket cylinder bodies 14, 24, 42, 43, 52, 53. For example, blanket cylinder body 42 would be absent, with circumferential sections 44 and 45 independently rotating about a common axis to receive images from plate 48 and print those images on web 37.

Figure 5:
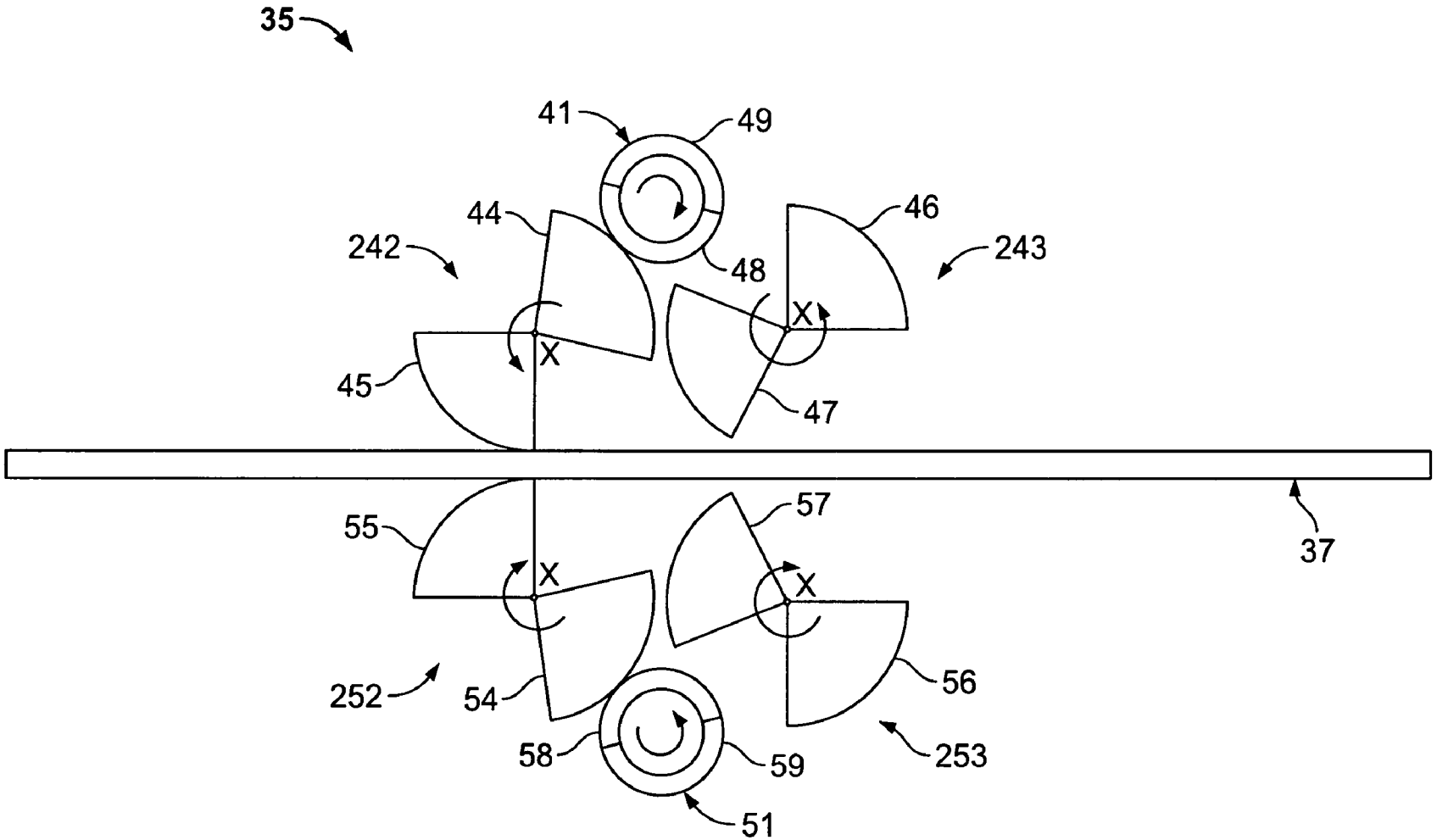
FIG. 5 shows a schematic side view of the perfecting printing press shown in FIGS. 4*a* to 4*c* without blanket cylinder bodies.

FIG. 5 shows a schematic side view of perfecting printing press 35 from FIGS. 4*a* to 4*c* without blanket cylinder bodies 42, 43, 52, 53. Circumferential sections 44, 45, 46, 47, 54, 55, 56, 57 rotate about shared respective axes X. Each circumferential section 44, 45, 46, 47, 54, 55, 56, 57 may rotate independent of all other circumferential sections 44, 45, 46, 47, 54, 55, 56, 57. Circumferential sections 44, 45, 46, 47, 54, 55, 56, 57 print in substantially the same manner as in perfecting printing press 35 in FIGS. 4*a* to 4*c*. Circumferential sections 44, 45, 46, 47, 54, 55, 56, 57 receive images from plates 48, 49, 58, 59, respectively, and print these images on web 37. Although the circumferential sections 44, 45, 46, 47, 54, 55, 56, 57 appear to be wedge-shaped in FIG. 5, circumferential sections 44, 45, 46, 47, 54, 55, 56, 57 may be in any form known to one of skill in the art that allows operation in the manner described herein, and may be driven by motors.

Cylinder as defined herein includes any rotating device.

In addition to the those embodiments described herein, where each plate cylinder 41 and 51 has only two plates 48, 49, 58, 59, respectively, more than two plates can be disposed around each plate cylinder 41 and 52. Each blanket cylinder 42, 43, 52, 53, can also have more than two circumferential sections 44, 45, 46, 47, 54, 55, 56, 57 disposed about each blanket cylinder 42, 43, 52, 53.

The present invention will be seen to have the advantage of printing various cutoff copies without changing blankets, blanket sleeves or plate sleeves.

The present invention will further be seen to have the advantage of a single plate size used for multiple print lengths.

The present invention will further be seen to have the advantage of infinite variability of print cutoff with a design range.

The present invention will further be seen to have the advantage of mixing cutoffs in line during the print process.

The present invention will be further seen to have the advantage of changing from one cutoff to another with no physical changes required to the press.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff printing press comprising:

a plate cylinder;

a first blanket cylinder including a first circumferential section movable circumferentially with respect to a second circumferential section during a printing mode; and a second blanket cylinder including a third circumferential section movable circumferentially with respect to a fourth circumferential section during the printing mode;

wherein the first, second, third and fourth circumferential sections contact the plate cylinder during the printing mode and print continuous images having a cutoff length on a web.

2. The variable cutoff printing press recited in claim 1 wherein the plate cylinder includes a first plate and a second plate, the first plate contacting the first and second circumferential sections during the printing mode and the second plate contacting the third and fourth circumferential sections during the printing mode.

3. The variable cutoff printing press recited in claim 2 wherein the first plate can be removed and replaced with a first replacement plate and the second plate can be removed and replaced with a second replacement plate;

wherein the first replacement plate contacts the first and second circumferential sections during the printing mode and the second replacement plate contacts the third and fourth circumferential sections during the printing mode and the first, second, third and fourth circumferential sections print continuous images having a second cutoff length on the web;

wherein the cutoff length varies from the second cutoff length.

4. The variable cutoff printing press recited in claim 1 further comprising a first impression cylinder and a second impression cylinder wherein the first and second circumferential sections contact the first impression cylinder via the web during the printing mode and the third and fourth circumferential sections contact the second impression cylinder via the web during the printing mode.

5. The variable cutoff printing press recited in claim 1 further comprising a lead roll directing the web.

6. The variable cutoff printing press recited in claim 1 wherein the first blanket cylinder includes a first cylinder body supporting the first and second circumferential sections and the second blanket cylinder includes a second cylinder body supporting the third and fourth circumferential sections.

7. The variable cutoff printing press recited in claim 1 wherein the first and second blanket cylinders are arranged and configured to print on the same side of the web.

8. The variable cutoff printing press recited in claim 7 wherein the first and second circumferential sections print image portions spaced apart from each other by a space on the web and the third circumferential section prints an image portion in the space on the web.

9. The variable cutoff printing press recited in claim 8 wherein the fourth circumferential section prints an image portion on the web directly following the image portion printed by the second circumferential section.

10. The variable cutoff printing press recited in claim 1 wherein a spacing between the first circumferential section and second circumferential section is variable during the printing mode.

11. The variable cutoff printing press recited in claim 1 further comprising a first motor driving the first circumferential section and a second motor driving the second circumferential section.

12. The variable cutoff printing press recited in claim 1 wherein the first and second circumferential sections are raised sections and are spaced apart from each other by two non-raised circumferential sections of the first blanket cylinder.

13. The variable cutoff printing press recited in claim 1 wherein velocities of the first and second circumferential sections are variable from a velocity of the plate cylinder during the printing mode.

14. The variable cutoff printing press recited in claim 1 wherein the first and second circumferential sections are each accelerated and decelerated during each revolution.

15. A method of printing an image on a web with a cutoff using the variable cutoff offset printing press recited in claim 1, the method comprising the steps of:

transferring an image to the first circumferential section the second circumferential section having a same rotational axis as the first circumferential section;

printing the image on a web with the first circumferential section;

transferring a second image to the second circumferential section; and printing the second image on the web with the second circumferential section.

16. A variable cutoff printing press comprising:

a plate cylinder, a first blanket cylinder including a first circumferential section movable with respect to a second circumferential section; and a second blanket cylinder including a third circumferential section movable with respect to a fourth circumferential section;

wherein the first, second, third and fourth circumferential sections contact the plate cylinder during a printing mode and print continuous images having a cutoff length on a web; and a third blanket cylinder and a fourth blanket cylinder wherein the first and second circumferential sections contact the third blanket cylinder via the web during the printing mode and the third and fourth circumferential sections contact the fourth blanket cylinder via the web during the printing mode.

17. A variable cutoff printing press comprising:

a plate cylinder;

a first blanket cylinder including a first circumferential section movable with respect to a second circumferential section; and a second blanket cylinder including a third circumferential section movable with respect to a fourth circumferential section;

wherein the first, second, third and fourth circumferential sections contact the plate cylinder during a printing mode and print continuous images having a cutoff length on a web; and a second plate cylinder;

a third blanket cylinder including a fifth circumferential section movable with respect to a sixth circumferential section; and a fourth blanket cylinder including a seventh circumferential section movable with respect to an eighth circumferential section;

wherein the fifth, sixth, seventh and eighth circumferential sections contact the second plate cylinder during a printing mode;

wherein the fifth circumferential section contacts the first circumferential section via the web during the printing mode, the sixth circumferential section contacts the second circumferential section via the web during the printing mode, the seventh circumferential section contacts the third circumferential section via the web during the printing mode, and the eighth circumferential sections contacts the fourth circumferential section via the web during the printing mode.

* * * * *